US012121785B1

(12) United States Patent
Wagstaff

(10) Patent No.: US 12,121,785 B1
(45) Date of Patent: Oct. 22, 2024

(54) GOLF TEE

(71) Applicant: Dr Bobs Inc, Springville, UT (US)

(72) Inventor: Robert K. Wagstaff, Springville, UT (US)

(73) Assignee: Dr Bobs Inc, Springville, UT (US)

( * ) Notice: Subject to any disclaimer, the term of this patent is extended or adjusted under 35 U.S.C. 154(b) by 0 days.

(21) Appl. No.: 18/459,073

(22) Filed: Aug. 31, 2023

(51) Int. Cl.
*A63B 57/10* (2015.01)

(52) U.S. Cl.
CPC ..... *A63B 57/10* (2015.10)

(58) Field of Classification Search
CPC ..... A63B 57/10; A63B 57/19
USPC ..... D21/717
See application file for complete search history.

(56) References Cited

U.S. PATENT DOCUMENTS

| | | | | |
|---|---|---|---|---|
| 1,554,721 | A * | 9/1925 | Getchell | A63B 57/10 473/403 |
| 1,671,813 | A | 5/1928 | Clarke | |
| 5,193,803 | A * | 3/1993 | Flick, III | A63B 57/10 473/392 |
| 5,413,330 | A * | 5/1995 | Disco | A63B 57/10 473/387 |
| 6,176,794 | B1 * | 1/2001 | Kim | A63B 57/10 473/392 |
| 6,960,143 | B2 * | 11/2005 | Sato | A63B 57/10 473/387 |
| 7,066,844 | B1 * | 6/2006 | Noggle | A63B 57/10 473/387 |
| D651,266 | S * | 12/2011 | Swagel | D21/718 |
| 8,597,141 | B1 * | 12/2013 | Daniel | A63B 57/16 473/387 |
| 10,569,148 | B2 | 2/2020 | Gauvin | |
| 10,870,043 | B2 * | 12/2020 | Cooper | A63B 57/10 |
| 2008/0234072 | A1 * | 9/2008 | Seaman | A63B 57/10 473/392 |
| 2014/0309057 | A1 * | 10/2014 | Reams | A63B 57/30 473/387 |
| 2015/0051020 | A1 * | 2/2015 | Duncan | A63B 69/3623 473/396 |

(Continued)

FOREIGN PATENT DOCUMENTS

| | | | |
|---|---|---|---|
| KR | 20100029353 A | * | 3/2010 |
| KR | 20220074285 A | * | 6/2022 |

OTHER PUBLICATIONS

Flightpath Golf, website, last accessed Aug. 29, 2023, <https://flightpathgolf.com/>.

*Primary Examiner* — Steven B Wong
(74) *Attorney, Agent, or Firm* — Kirton McConkie; Brian Tucker

(57) ABSTRACT

A golf tee may include a shaft and a head coupled to the shaft. The head may include a base, a rear portion that extends upwardly from a rear of the base, and opposing sides portions that extend upwardly from opposing sides of the base to thereby form a hollow interior above the base and between the side portions. The rear portion may include a raised support that extends upwardly from a top of the rear portion and forms a rear support point for supporting a golf ball on the head of the golf tee. A top of each side portion may form a rail having an upper surface. The upper surface at a rear of each rail may be positioned below the raised support. The upper surface may be angled upwardly towards a front of the rail to form a front support point at the front of each rail.

20 Claims, 7 Drawing Sheets

(56) References Cited

U.S. PATENT DOCUMENTS

| | | | | |
|---|---|---|---|---|
| 2016/0166898 | A1* | 6/2016 | Dastrup | A63B 57/10<br>473/402 |
| 2020/0030674 | A1* | 1/2020 | Rice | A63B 57/10 |

* cited by examiner

GOLF TEE

CROSS-REFERENCE TO RELATED APPLICATIONS

N/A

BACKGROUND

Golf tees are used to elevate a golf ball off the ground. A typical golf tee includes a head in the form of a cup and a shaft that extends downwardly from the head. The shaft is inserted into the ground to position the head at a desired height. The golf ball is positioned on the cup-shaped head and may then be hit using a golf club. Some golf tees that are designed to reduce friction configure the head to form a circular arrangement of prongs.

BRIEF SUMMARY

The present disclosure relates to golf tees. In particular, golf tees configured in accordance with embodiments of the present disclosure may facilitate enhanced contact between the club face and the golf ball and may reduce interference as the golf ball leaves the golf tee. As a result, golf balls struck from such golf tees may have greater distance, spin, trajectory, or other improvement.

In some embodiments, a golf tee may include a shaft and a head coupled to the shaft. The head may include a base, a rear portion that extends upwardly from a rear of the base, and opposing sides portions that extend upwardly from opposing sides of the base to thereby form a hollow interior above the base and between the side portions. The rear portion may include a raised support that extends upwardly from a top of the rear portion and forms a rear support point for supporting a golf ball on the head of the golf tee. A top of each side portion may form a rail. Each rail may have an upper surface. The upper surface at a rear of each rail may be positioned below the raised support of the rear portion and the upper surface may be angled upwardly towards a front of the rail to form a front support point at the front of each rail for supporting the golf ball on the head of the golf tee.

In some embodiments, each rail may extend frontwardly beyond a front of the base such that the front support points are positioned frontward of the front of the base.

In some embodiments, a front of each side portion and a front of the base may form a front opening into the hollow interior.

In some embodiments, the front of each side portion may extend rearwardly and downwardly from the front of the respective rail towards the front of the base.

In some embodiments, the upper surface at the front of each rail may be flattened relative to the remainder of the upper surface. The flattened portion of the upper surface may form the respective front support point.

In some embodiments, the front support points and the rear support point may lie in a plane and the upper surface of the rails may be oriented downwardly at an angle from the plane.

In some embodiments, the angle from the plane may be approximately 6 degrees.

In some embodiments, the shaft may be angled rearwardly from an axis perpendicular to the plane.

In some embodiments, the angle of the shaft relative to the axis may be approximately 3 degrees.

In some embodiments, the raised support may extend across a width of the rear portion.

In some embodiments, the raised support may extend across a portion of a width of the rear portion.

In some embodiments, the raised support may extend upwardly only from opposing sides of the rear portion to thereby form two rear support points.

In some embodiments, the shaft may include one or more steps.

In some embodiments, a front of the rear portion may include ribs.

In some embodiments, each side portion may be coupled to the rear portion to thereby enclose the hollow interior at the rear and sides of the head.

In some embodiments, a golf tee may include a shaft and a head coupled to the shaft. The head may include a base, a rear portion that extends upwardly from a rear of the base, and opposing sides portions that extend upwardly from opposing sides of the base and frontwardly from the rear portion to thereby form a hollow interior above the base and between the side portions. The hollow interior may include a front opening. The rear portion may include a raised support that extends upwardly from a top of the rear portion and forms at least one rear support point for supporting a golf ball on the head of the golf tee. A top of each side portion may form a rail having an upper surface. The upper surface at a rear of each rail may be positioned below the raised support of the rear portion and the upper surface at a front of each rail may be positioned above the raised support and may form a front support point for supporting the golf ball on the head of the golf tee.

In some embodiments, the front support points and the at least one rear support point may lie in a plane and the shaft may be angled rearwardly relative to an axis that is perpendicular to the plane.

In some embodiments, a front of each side portion and a front of the base may form the front opening.

In some embodiments, the front support points may be positioned frontward of the front of the base.

In some embodiments, a golf tee may include a shaft and a head coupled to the shaft. The head may include a base, a rear portion that extends upwardly from a rear of the base, and opposing sides portions that extend upwardly from opposing sides of the base. The rear portion may include a raised support that extends upwardly from a top of the rear portion and may form a rear support point for supporting a golf ball on the head of the golf tee. A top of each side portion may form a rail having an upper surface. The upper surface at a rear of each rail may be positioned below the raised support of the rear portion and the upper surface at a front of each rail may be positioned above the raised support of the rear portion to form a front support point at the front of each rail for supporting the golf ball on the head of the golf tee. The front support points may be positioned frontward of a front of the base. The rear support point and the front support points may lie in a plane and the shaft may be angled rearwardly from an axis that is perpendicular to the plane.

This summary is provided to introduce a selection of concepts in a simplified form that are further described below in the Detailed Description. This summary is not intended to identify key features or essential features of the claimed subject matter.

BRIEF DESCRIPTION OF THE DRAWINGS

Understanding that these drawings depict only typical embodiments of the present disclosure and are not therefore to be considered limiting of its scope, the present disclosure will be described and explained with additional specificity and detail through the use of the accompanying drawings in which.

DETAILED DESCRIPTION

Figure 1:
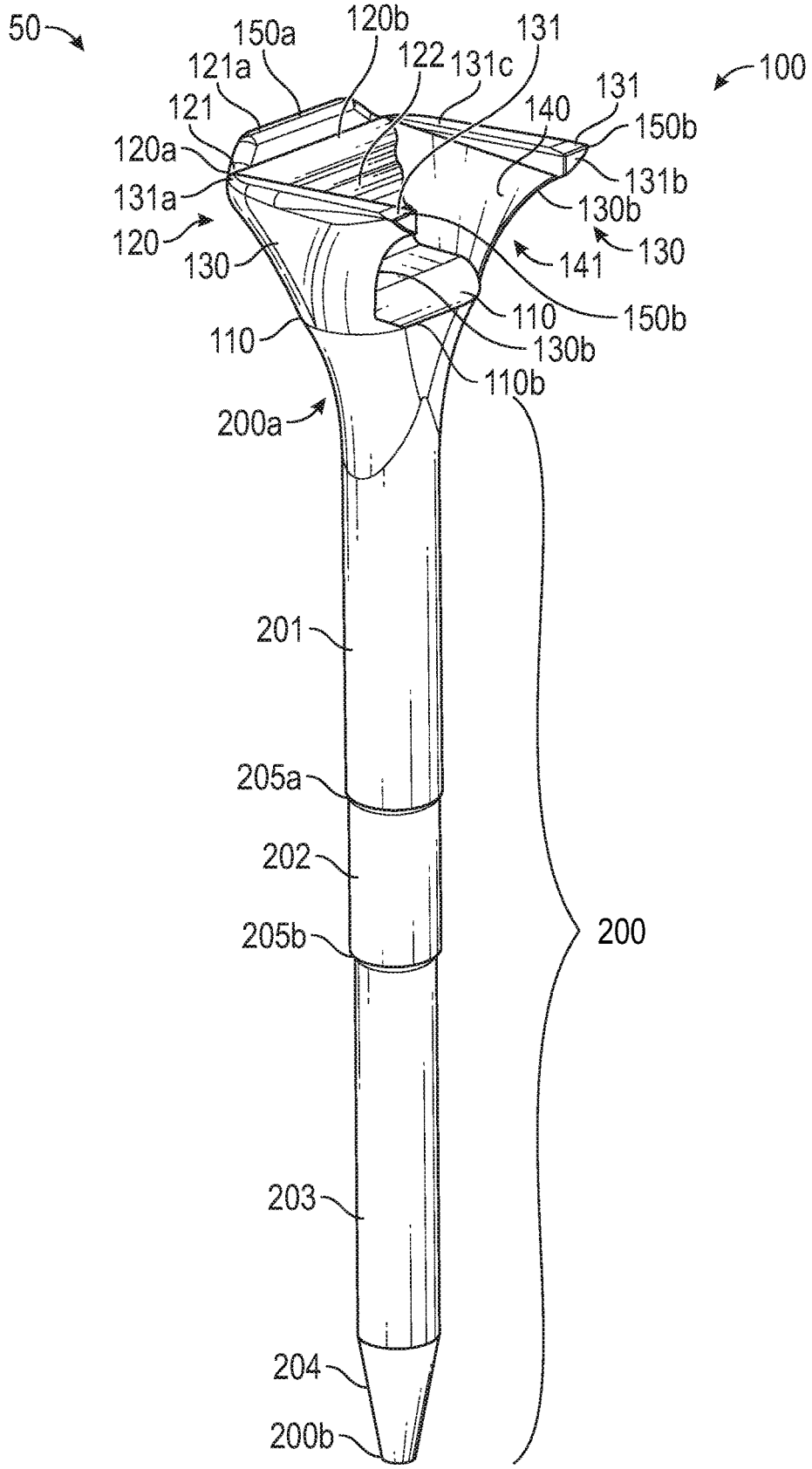
FIG. 1 is a perspective view of a golf tee that is configured in accordance with one or more embodiments of the present disclosure.

In this specification and the claims, the terms "front" and "rear" are used to reference portions of a golf tee that are intended to be positioned towards the front foot and rear foot respectively of the golfer when the golfer hits a golf ball supported by the golf tee. For example, for a righthanded golfer, a rear portion of the golf tee is intended to be on the golfer's right and a front portion of the golf tee is intended to be on the golfer's left. The term "side" is used to reference the portions of the golf tee that extend between the front and rear of the golf tee. For example, an inner side of the golf tee faces the golfer and an outer side of the golf tee faces away from the golfer when the golfer hits the golf ball supported on the golf tee. The term "approximately" should be construed as encompassing a stated value and values within 10% of the stated value.

FIGS. 1-6 illustrate one example of a golf tee 50 that is configured in accordance with one or more embodiments of the present disclosure. Golf tee 50 includes a head 100 and a shaft 200. Shaft 200 extends downwardly from head 100 and can therefore be inserted into the ground to position head 100 at a desired height above the ground. However, in some embodiments head 100 may be positioned on top of other shafts. For example, head 100 could be coupled to a shaft that is configured to be semi-permanently integrated into a mat at a driving range.

Head 100 includes a base 110 by which head 100 is coupled to shaft 200, a rear portion 120 that extends upwardly from base 110 and opposing side portions 130 that extend upwardly from opposing sides of base 110 and frontwardly from rear portion 120. Head 100 does not include a front portion such that a front opening 141 exists into a hollow interior 140 formed above base 110 and between side portions 130.

Rear portion 120 may include a raised support 121 that extends upwardly from a top 120*a* of rear portion 120. In the depicted embodiments, raised support 121 spans across the width of rear portion 120 and forms a surface 121*a* on which a golf ball may rest when the golf ball is supported by golf tee 50. Surface 121*a* therefore forms a rear support point 150*a* for a golf ball (not shown). In this context, the width of rear portion 120 can be considered the distance between opposing side portions 130. In other embodiments, raised support 121 could span across rear portion 120 to a lesser extent such as only in a middle section of rear portion 120. In some embodiments, this middle section could encompass up to 10%, 20%, 30%, 40%, 50% or another percentage of the width of rear portion 120. In some embodiments, including the depicted embodiments, a front 120*b* of rear portion 120 may include ribs 122 which may reinforce rear portion 120 against the force of a golf club.

Figure 2:
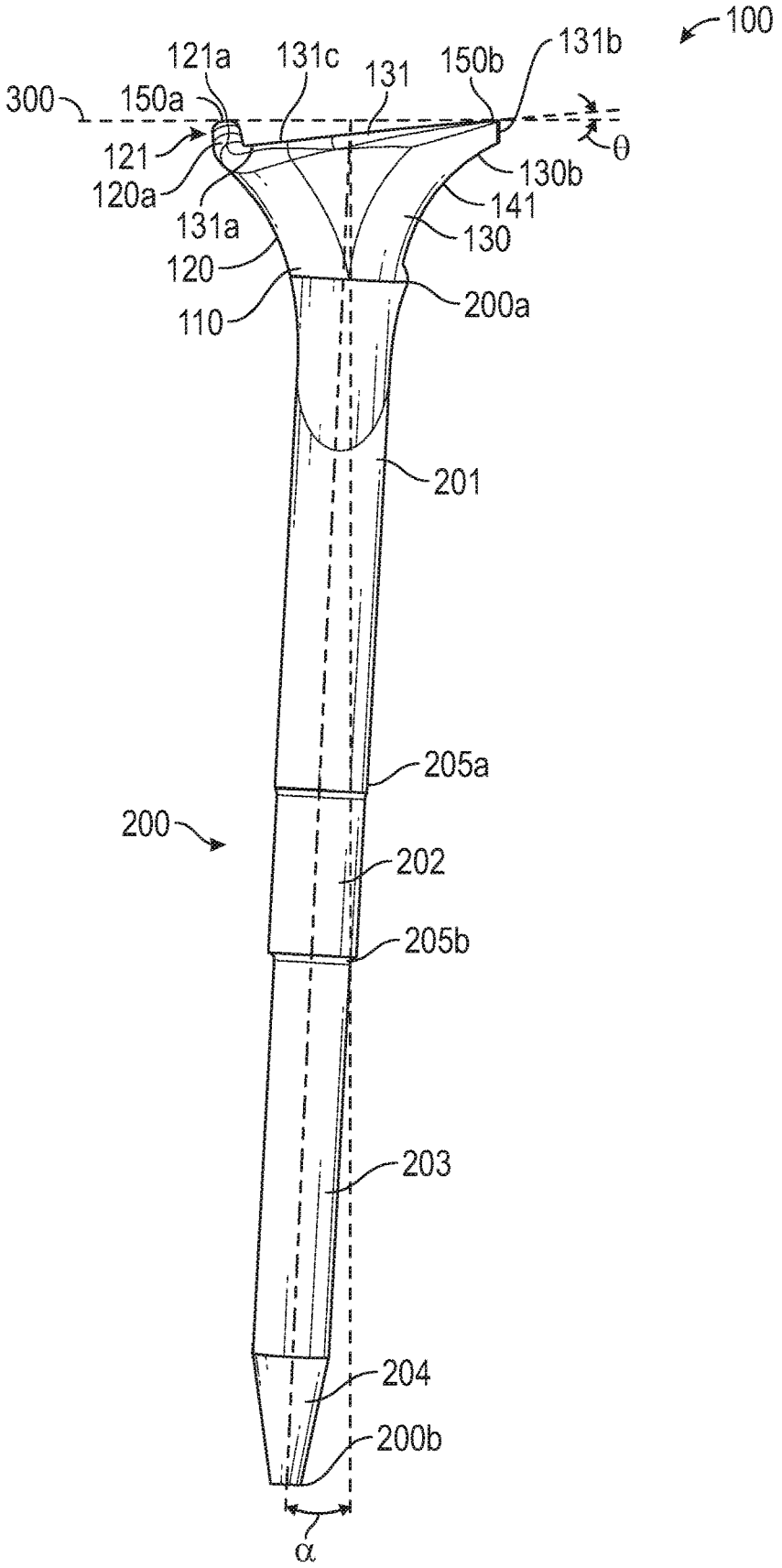
FIG. 2 is a side view of the golf tee of FIG. 1.
Figure 3:
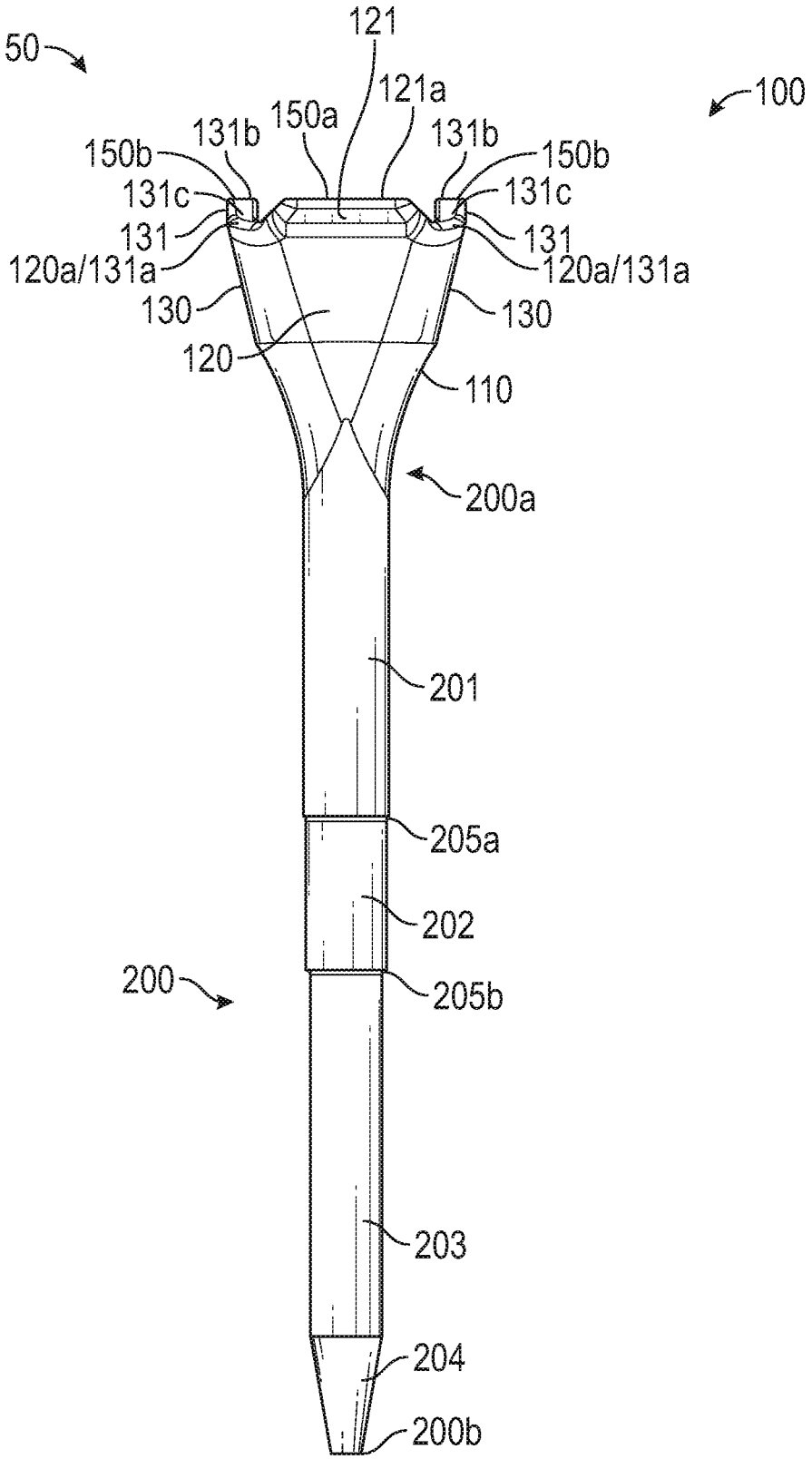
FIG. 3 is a rear view of the golf tee of FIG. 1.
Figure 4:
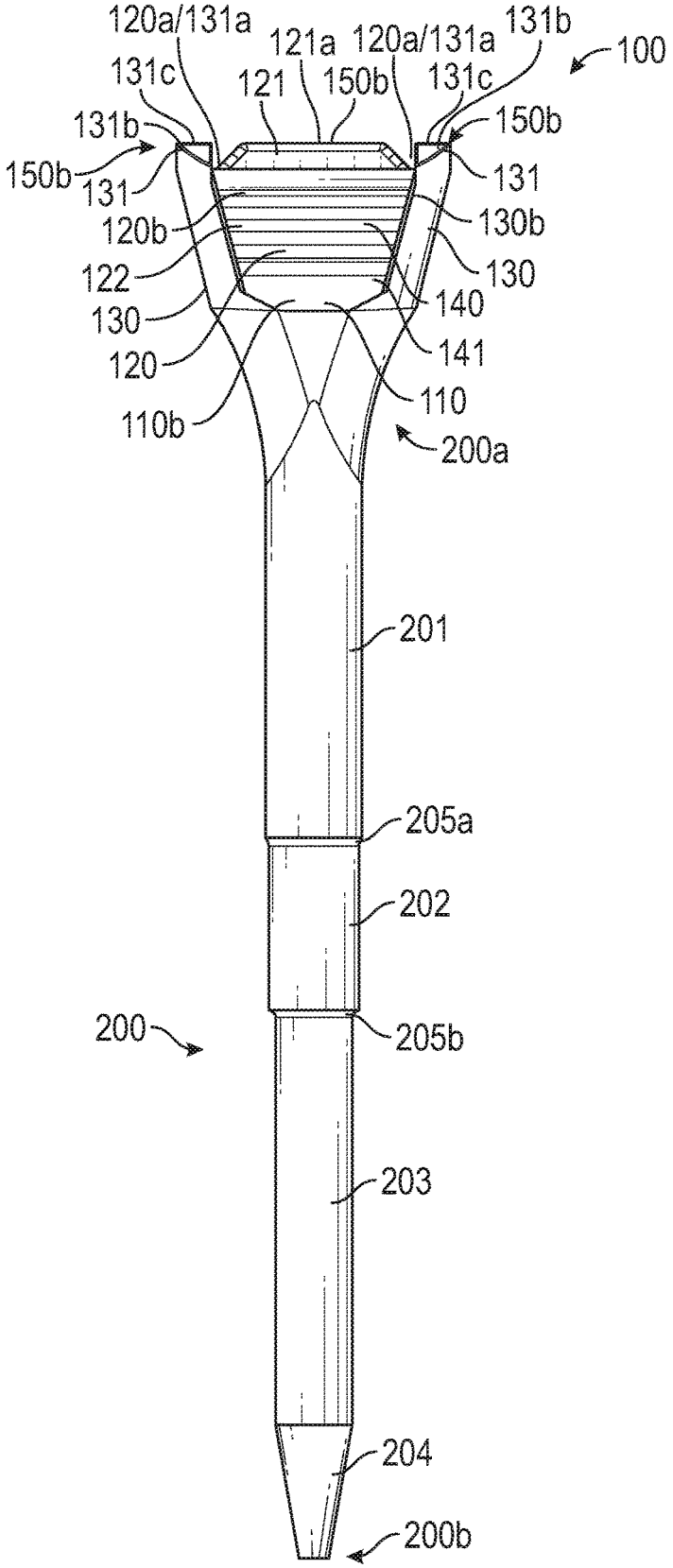
FIG. 4 is a front view of the golf tee of FIG. 1.
Figure 5:
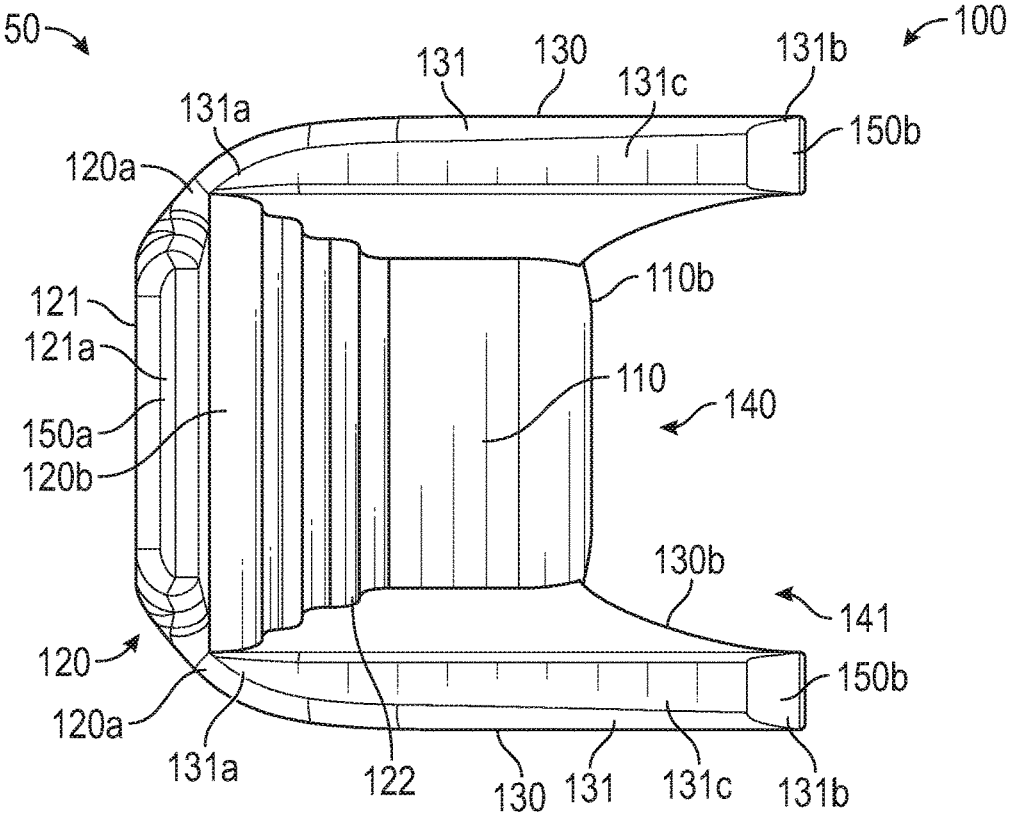
FIG. 5 is a top view of the golf tee of FIG. 1.
Figure 6:
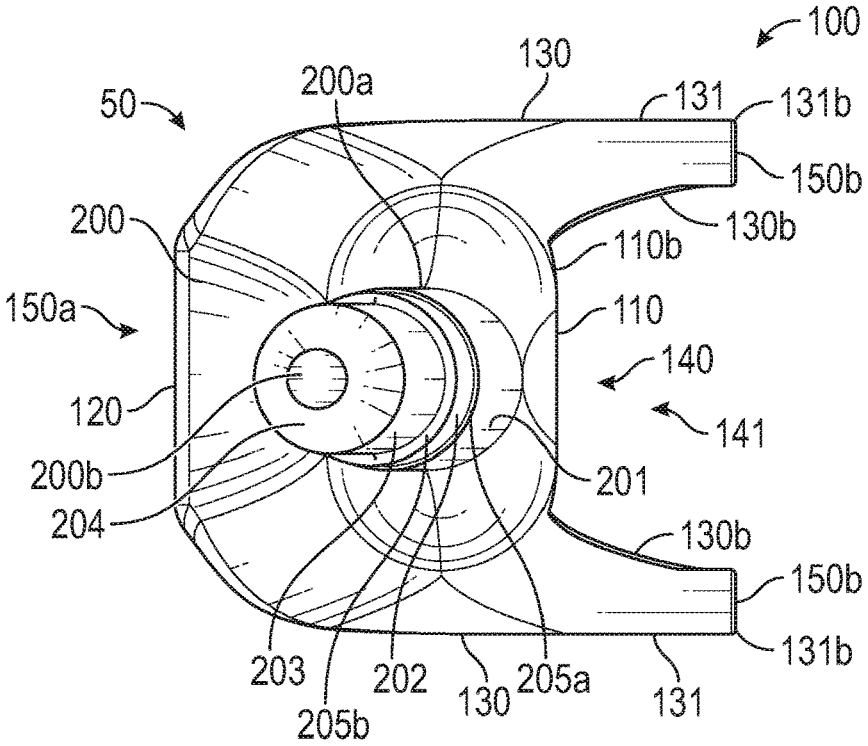
FIG. 6 is a bottom view of the golf tee of FIG. 1.

Each side portion 130 may include a rail 131 forming a top of the side portion. A rear 131*a* of each rail 131 may couple to rear portion 120. In some embodiments, an upper surface 131*c* of each rail 131 at rear 131*a* may be substantially level with top 120*a*. As best shown in FIG. 2, upper surface 131*c* may be sloped upwardly at an angle (θ) towards a front 131*b* of each rail 131. Upper surface 131*c* at front 131*b* of each rail 131 may form front support points 150*b*. Accordingly, head 100 forms three points for supporting a golf ball. In some embodiments, and as is best shown in FIG. 2, rear support point 150*a* and front support points 150*b* may lie in the same plane.

As represented in FIG. 2, rear support point 150*a* and front support points 150*b* may lie in a horizontal plane 300 when golf tee 50 is angled rearwardly. In some embodiments, the angle (θ) at which upper surface 131*c* is oriented relative to horizontal plane 300 may be between 2° and 10°, between 4° and 8°, between 5° and 7°, or approximately 6°. This angle of upper surface 131*c* minimizes contact between head 100 and the golf ball and may facilitate the launching of the golf ball at a desirable launch angle when struck from golf tee 50 as described below with reference to FIG. 7. In some embodiments, the portion of upper surface 131*c* that forms front support points 150*b* may be flattened relative to the remainder of upper surface 131*c* to further minimize interference between rails 131 and the golf ball when the golf ball is struck.

In some embodiments, a front 130*b* of each side portion 130 may extend rearwardly and downwardly from front 131*b* of rail 131 towards a front 110*b* of base 110. As such, front support points 150*b* can be positioned frontward of front 110*b* of base 110. In some embodiments, front 130*b* may curve rearwardly and downwardly relative to front 110*b* of base 110. As such, no material of golf tee 50 is positioned between or below front support points 150*b*.

Shaft 200 includes a top 200*a* that is coupled to base 110 of head 100 and a bottom 200*b* forming the bottom of golf tee 50. In some embodiments, shaft 200 may include multiple segments of different diameters or thicknesses. For example, in the depicted embodiments, shaft 200 includes an upper section 201, a first intermediate section 202, a second intermediate section 203 and a bottom section 204. First intermediate section 202 may have a smaller diameter than upper section 201 and second intermediate section 203 may have a smaller diameter than first intermediate section 202 to thereby create steps 205*a* and 205*b* respectively. Upper section 201, first intermediate section 202 and second intermediate section 203 can be configured relative to one another to cause steps 205*a* and 205*b* to be positioned at distances from bottom 200*b* representing insertion depths of shaft 200 that position head 100, and therefore the golf ball, at a desirable height above the ground. In such embodiments, the golfer can quickly and easily position the golf ball at the desired height by inserting shaft 200 until step 205*a* or step 205*b* is level with the ground. Bottom section 204 may be tapered to facilitate inserting shaft 200 into the ground.

In some embodiments, and as best shown in FIG. 2, shaft 200 may be angled rearwardly relative to horizontal plane 300. For example, with golf tee 50 oriented to create horizontal plane 300, the angle (a) of shaft 200 relative to the vertical may be between 1° and 5°, between 2° and 4°, or approximately 3°.

Figure 7:
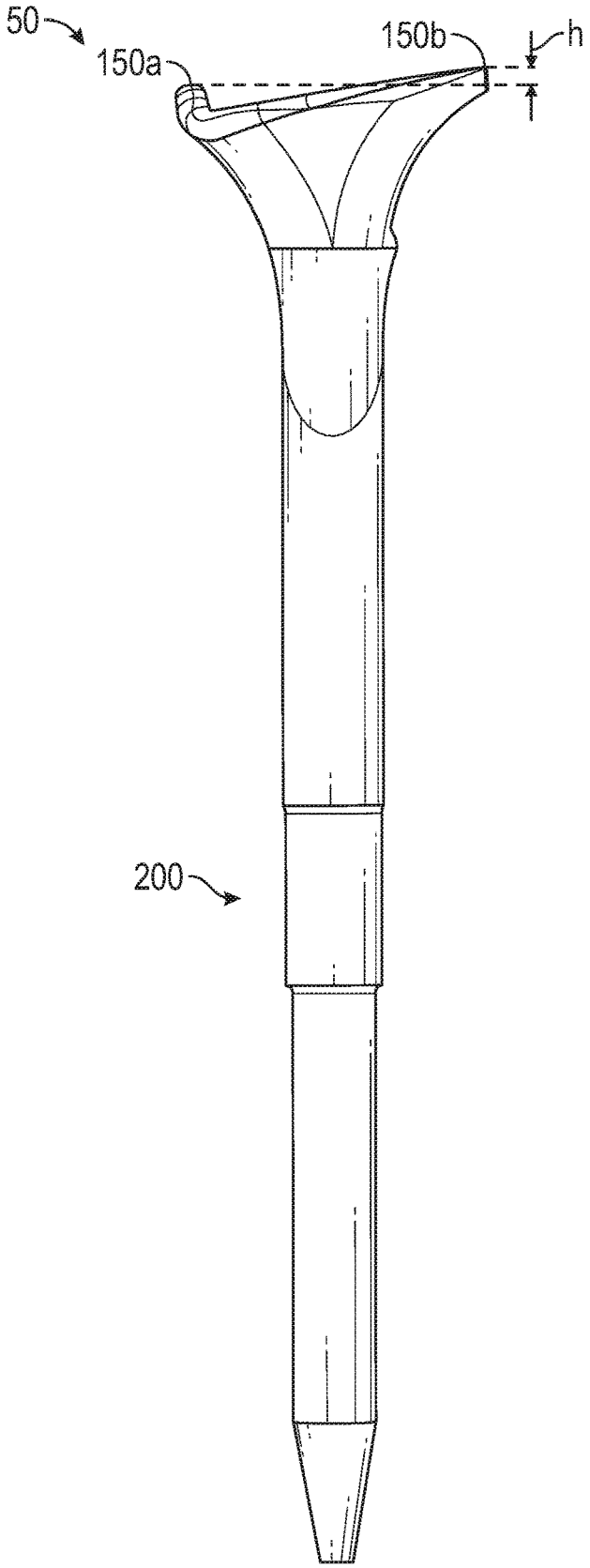
FIG. 7 is a side view of the golf tee of FIG. 1 when the shaft of the golf tee is vertically oriented.

FIG. 7 is the same as FIG. 2 except that golf tee 50 has been rotated so that shaft 200 is vertical. In some embodiments, the orientation of golf tee 50 in FIG. 7 may be the intended orientation for golf tee 50 during use. In this orientation, front support points 150*b* are positioned at a height (h) above rear support point 150*a*. The face of a golf club, such as a driver, is angled upward. Accordingly, by positioning front support points 150*b* above rear support point 150*a*, the golf ball can be supported in a manner that generally corresponds with the orientation of the face of the golf club which can minimize interference between the golf ball and rails 131 and/or enhance the launch angle of the golf ball. Furthermore, with this positioning of rear support point 150*a* below front support points 150*b*, more than a third of the weight of the golf ball may be supported by rear support point 150*a* to thereby cause the golf ball to respond more to the face of the golf club when struck. For example, golf tee 50 can facilitate striking the golf ball either above or below the center line of the club face to accomplish greater top spin or back spin respectively.

Figure 8:
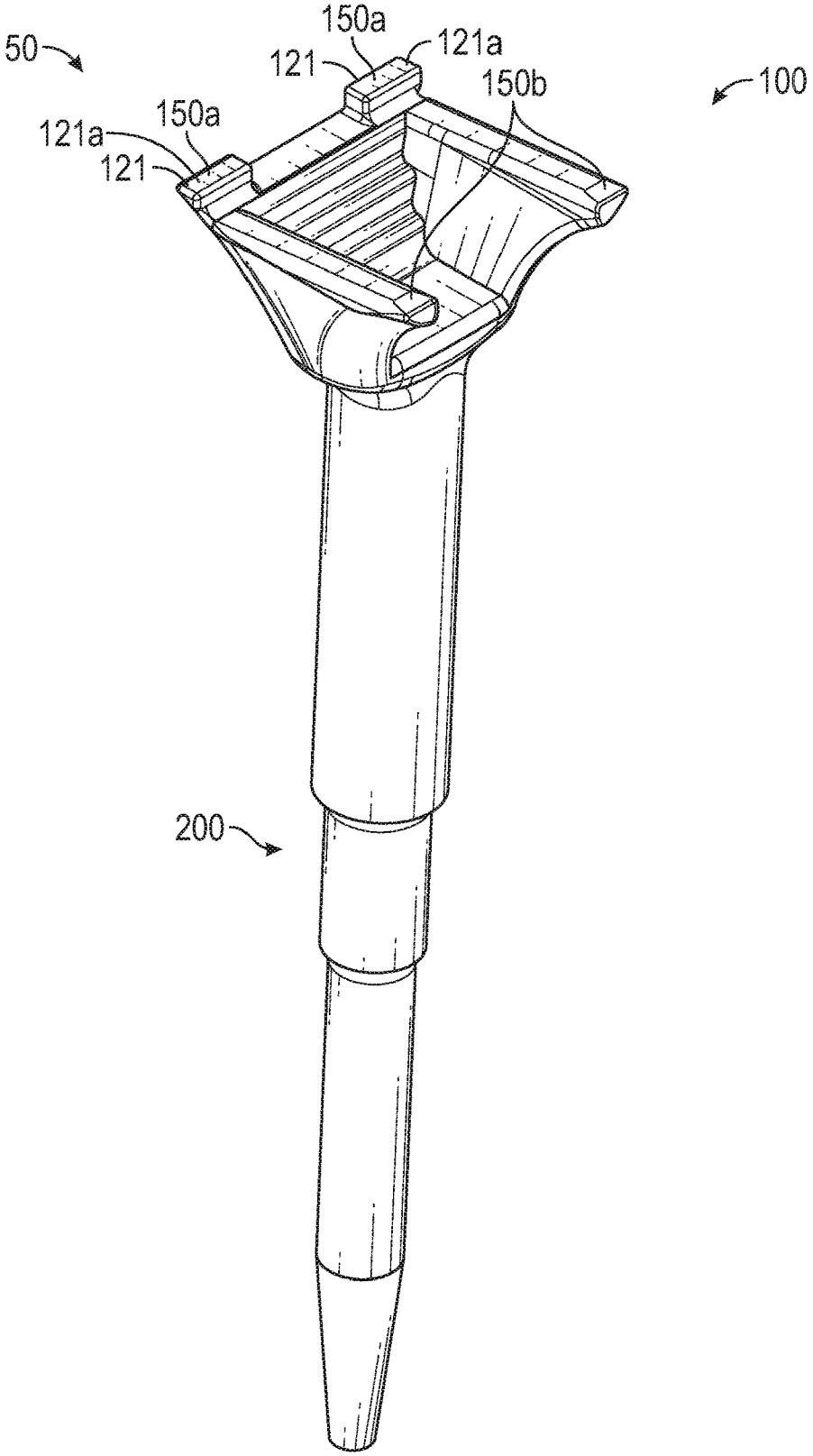
FIG. 8 is a perspective view of another golf tee that is configured in accordance with one or more embodiments of the present disclosure.

FIG. 8 illustrates one possible variation for golf tee 50. In FIG. 8, raised support 121 extends upwardly only from opposing sides of rear portion 120. In other words, in such embodiments, raised support 121 can be considered as having a central cutout, or rear portion 120 can be considered as having opposing and spaced apart raised supports 121. In any case, in such embodiments, surface 121*a* forms two rear support points 150*a* such that head 100 forms a total of four support points. Providing two rear support points 150*a* in this manner can further minimize interference between the golf ball and head 100 when the golf ball is struck.

What is claimed:

1. A golf tee comprising:

a shaft; and a head coupled to the shaft, the head comprising a base, a rear portion that extends upwardly from a rear of the base, and opposing sides portions that extend upwardly from opposing sides of the base to thereby form a hollow interior above the base and between the side portions;

wherein the rear portion includes a raised support that extends upwardly from a top of the rear portion and forms a rear support point for supporting a golf ball on the head of the golf tee;

wherein a top of each side portion forms a rail, each rail having an upper surface, wherein the upper surface at a rear of each rail is positioned below the raised support of the rear portion and the upper surface is angled upwardly towards a front of the rail to form a front support point at the front of each rail for supporting the golf ball on the head of the golf tee;

wherein each side portion is coupled to the rear portion to thereby enclose the hollow interior at the rear and sides of the head.

2. The golf tee of claim 1, wherein each rail extends frontwardly beyond a front of the base such that the front support points are positioned frontward of the front of the base.

3. The golf tee of claim 1, wherein a front of each side portion and a front of the base form a front opening into the hollow interior.

4. The golf tee of claim 3, wherein the front of each side portion extends rearwardly and downwardly from the front of the respective rail towards the front of the base.

5. The golf tee of claim 1, wherein the upper surface at the front of each rail is flattened relative to the remainder of the upper surface, the flattened portion of the upper surface forming the respective front support point.

6. The golf tee of claim 1, wherein the front support points and the rear support point lie in a plane and the upper surface of the rails are oriented downwardly at an angle from the plane.

7. The golf tee of claim 6, wherein the angle from the plane is approximately 6 degrees.

8. The golf tee of claim 6, wherein the shaft is angled rearwardly from an axis perpendicular to the plane.

9. The golf tee of claim 8, wherein the angle of the shaft relative to the axis is approximately 3 degrees.

10. The golf tee of claim 1, wherein the raised support extends across a width of the rear portion.

11. The golf tee of claim 1, wherein the raised support extends across a portion of a width of the rear portion.

12. The golf tee of claim 1, wherein the raised support extends upwardly only from opposing sides of the rear portion to thereby form two rear support points.

13. The golf tee of claim 1, wherein the shaft includes one or more steps.

14. The golf tee of claim 1, wherein a front of the rear portion includes ribs.

15. A golf tee comprising:

a shaft; and a head coupled to the shaft, the head comprising a base, a rear portion that extends upwardly from a rear of the base, and opposing sides portions that extend upwardly from opposing sides of the base and frontwardly from the rear portion to thereby form a hollow interior above the base and between the side portions, the hollow interior including a front opening;

wherein the rear portion includes a raised support that extends upwardly from a top of the rear portion and forms at least one rear support point for supporting a golf ball on the head of the golf tee;

wherein a top of each side portion forms a rail, each rail having an upper surface, wherein the upper surface at a rear of each rail is positioned below the raised support of the rear portion and the upper surface at a front of each rail is positioned above the raised support and forms a front support point for supporting the golf ball on the head of the golf tee;

wherein a front of each side portion extends rearwardly and downwardly from a front of the corresponding rail and towards a front of the base, the front of each side portion and the front of the base forming the front opening.

16. The golf tee of claim 15, wherein the front support points and the at least one rear support point lie in a plane and wherein the shaft is angled rearwardly relative to an axis that is perpendicular to the plane.

17. The golf tee of claim 15, wherein the front of each side portion is curved.

18. The golf tee of claim 15, wherein the front support points are positioned frontward of the front of the base.

19. A golf tee comprising:

a shaft; and a head coupled to the shaft, the head comprising a base, a rear portion that extends upwardly from a rear of the base, and opposing sides portions that extend upwardly from opposing sides of the base;

wherein the rear portion includes a raised support that extends upwardly from a top of the rear portion and forms a rear support point for supporting a golf ball on the head of the golf tee;

wherein a top of each side portion forms a rail, each rail having an upper surface, wherein the upper surface at a rear of each rail is positioned below the raised support of the rear portion and the upper surface at a front of each rail is positioned above the raised support of the rear portion to form a front support point at the front of each rail for supporting the golf ball on the head of the golf tee, the front support points being positioned frontward of a front of the base;

wherein the rear support point and the front support points lie in a plane and the shaft is angled rearwardly from an axis that is perpendicular to the plane;

wherein each side portion is coupled to the rear portion to thereby enclose the hollow interior at the rear and sides of the head.

20. The golf tee of claim 19, wherein a front of each side portion extends rearwardly and downwardly from the front of the corresponding rail and towards the front of the base, the front of each side portion and the front of the base forming the front opening.

* * * * *